US006039477A

United States Patent [19]

Matsuura

[11] Patent Number: 6,039,477

[45] Date of Patent: Mar. 21, 2000

[54] INK RIBBON TAKE-UP MECHANISM HAVING TRANSFER MEMBER

[75] Inventor: Takanobu Matsuura, Iwate-ken, Japan

[73] Assignee: Alps Electric Co., Ltd., Tokyo, Japan

[21] Appl. No.: 09/165,607

[22] Filed: Oct. 2, 1998

[30] Foreign Application Priority Data

Oct. 16, 1997 [JP] Japan ..... 9-283574

[51] Int. Cl.[7] ..... B41J 33/16

[52] U.S. Cl. ..... 400/236; 400/236.2

[58] Field of Search ..... 400/236, 236.2, 400/234, 231, 225, 223

[56] References Cited

U.S. PATENT DOCUMENTS

| | | | |
|---|---|---|---|
| 3,825,103 | 7/1974 | Riley | 400/236 |
| 4,606,662 | 8/1986 | Komplin | 400/214 |
| 4,611,937 | 9/1986 | Sato et al. | 400/236 |
| 4,850,725 | 7/1989 | Walker et al. | 400/236.2 |
| 4,921,363 | 5/1990 | Nishihara et al. | 400/208 |
| 5,096,315 | 3/1992 | Yamamoto et al. | 400/222 |
| 5,399,036 | 3/1995 | Yamaguchi | 400/236 |
| 5,476,330 | 12/1995 | Inoue et al. | 400/208 |
| 5,538,351 | 7/1996 | Miyano | 400/206 |
| 5,876,130 | 3/1999 | Lee | 400/211 |

FOREIGN PATENT DOCUMENTS

| | | |
|---|---|---|
| 61-114878 | 6/1986 | Japan . |
| 61-132374 | 6/1986 | Japan . |
| 62-288071 | 12/1987 | Japan . |
| 7089198A | 4/1995 | Japan . |
| 8310092A | 11/1996 | Japan . |

*Primary Examiner*—John S. Hilten
*Assistant Examiner*—Leslie J. Grohusky
*Attorney, Agent, or Firm*—Brinks, Hofer,Gilson & Lione

[57] ABSTRACT

It is an object of the present invention to provide an ink ribbon take-up mechanism whereby a core and a pinch roller both disposed in an ink ribbon cassette are prevented from being tilted or wobbled under the tension of an ink ribbon housed within the ink ribbon cassette while a carriage is driven (during printing), thereby permitting the core and the pinch roller to be rotated in a more stable manner. The ink ribbon take-up mechanism comprises a support shaft projected from a ribbon cassette loading surface of a carriage to a ribbon cassette loading side and adapted to be inserted into an engaging portion formed on the ribbon cassette side to support the ribbon cassette, and a drive transfer member disposed rotatably on an outer periphery side of the support shaft and adapted to be engaged with the engaging portion formed on the ribbon cassette side to transmit a rotative driving force of a motor to the engaging portion.

2 Claims, 4 Drawing Sheets

INK RIBBON TAKE-UP MECHANISM HAVING TRANSFER MEMBER

BACKGROUND OF THE INVENTION

1. Field of the Invention

The present invention relates to an ink ribbon take-up mechanism for taking up an ink ribbon in a ribbon cassette which is loaded onto a carriage of a printer.

2. Description of the Related Art

FIG. 6 shows a principal portion of a conventional thermal transfer printer. As shown in the same figure, a flat plate-like platen 42 is disposed at an approximate center of a frame of a printer 41 in such a manner that a printing surface thereof is substantially vertical. In front of the platen 42 of the frame is disposed a carriage shaft 43 at a lower position and in parallel with the platen 42. Onto the carriage shaft 43 is mounted a carriage 44 so that it can reciprocate along the carriage shaft 43. At a front end portion of the carriage 44 is mounted a thermal head 45 in an opposed relation to the platen 42. On the upper surface of the carriage 44 are disposed a take-up bobbin 47 for taking up an ink ribbon R housed within a ribbon cassette 46 and a delivery bobbin 48 delivering the ink ribbon R. The ribbon cassette 46 is loaded onto the carriage 44 so that the ink ribbon R received therein is guided to between the thermal head 45 and the platen 42. Further, on the upper surface of the carriage 44 is disposed a second take-up bobbin 49 rotatably on a downstream side of the thermal head 45 in the traveling path of the ink ribbon R, while on an upstream side of the thermal head is disposed a second delivery bobbin 50 rotatably.

FIG. 7 shows a principal portion of a conventional ink ribbon take-up mechanism, in which an outwardly projecting support flange 52 is formed integrally at a lower end portion of a take-up shaft 51, and a take-up gear 53 is fitted on the lower end portion of the take-up shaft 51 in a rotatable manner independently of the take-up shaft 51. A felt member 54 serving as a frictional slide mechanism is interposed between the take-up gear 53 and the support flange 52 of the take-up shaft 51. Onto an upper end portion of the take-up shaft 51 is fixed a take-up bobbin 47 which is exposed to the upper surface of the carriage 44 and which is brought into engagement with a shaft hole 65 formed in a core 55 of the ribbon cassette 46. On the outer peripheral surface of the take-up bobbin 47 are formed a plurality of engaging projections 56 circumferentially at equal intervals, while in the underside of the take-up bobbin 47 is formed an annular retaining ring 57. On the outer periphery side of the take-up shaft 51 is disposed a biasing spring 58 whose upper end portion is anchored in the retaining groove 57 of the take-up bobbin 47 and whose lower end portion is in abutment with the upper surface of the take-up gear 53. With the biasing force of the biasing spring 58, the take-up gear 53 is brought into pressure contact with the support flange 52 of the take-up shaft 51 through the felt member 54.

As shown in FIG. 8, a drive gear 61 fixed onto a rotating shaft 60 of a take-up motor for the ink ribbon R is in mesh with the take-up gear 53. The drive gear 61 is rotated by rotation of the take-up motor 59 for the ink ribbon R, thereby causing the take-up gear 53 to rotate. As a result, with a frictional force of the felt member 54 created by the biasing force of the biasing spring 58 of the take-up gear 53, the rotative driving force is transmitted to the take-up shaft 51. The take-up shaft 51 is supported rotatably on a support shaft 51A whose base end portion is fixed to the carriage 44.

On the other hand, the ribbon cassette 46 loaded onto the upper surface of the carriage 44 is constructed as in FIG. 9 in which, in the interior of a case body 62 which is generally rectangular in plan, are disposed a pair of cores 55, 55 supported rotatably, a pair of pinch rollers 63, 63 supported rotatably for peeling off the ink ribbon, and a plurality of guide rollers (not shown) supported rotatably and facing the ribbon traveling path.

The paired cores 55, 55 are formed in a generally cylindrical shape and both ends of the ink ribbon R, which is a heat-subliming or heat-melting ink ribbon, are wound round the outer peripheral surfaces of the cores 55, 55, respectively. When the ribbon cassette 46 is loaded onto the carriage 44 of the printer used, one of the paired cores 55, 55 comes into engagement with the take-up bobbin 47 and serves as a take-up core 55A for taking up the portion, which has been used for printing, of the ink ribbon R, while the other core 55 comes into engagement with the delivery bobbin 48 and serves as a feed core 55B which feeds the ink ribbon R for printing. As to the pinch rollers, one pinch roller 63A comes into engagement with the second take-up bobbin 49 and provides a peeling force for the ink ribbon R during printing, while the other pinch roller 63B comes into engagement with the second delivery bobbin 50 and acts to impart a peeling torque to the ink ribbon.

In the inner peripheral surface of each core 55 are formed a plurality of engaging grooves 64 in a splined shape circumferentially at predetermined intervals. The inside of the inner peripheral surface of each core 55 define the shaft hole 65 for engagement with the take-up bobbin 47 or the delivery bobbin 48 formed on the carriage 44 of the printer.

In the conventional printer 41 described above, paper is inserted from a paper insertion port (not shown) formed behind the platen 42 and is conveyed in a direction perpendicular to the moving direction of the carriage 44 at a predetermined speed by means of a paper conveying mechanism (not shown). On the other hand, the thermal head 45 is brought into pressure contact with the paper at a predetermined pressure. In this state, the carriage 44 is moved and the take-up bobbin 47 is rotated to take up the ink ribbon R in the ribbon cassette 46, while the thermal head 45 is driven in accordance with a desired printing signal to effect a desired printing for the paper.

Thus, in the above ink ribbon take-up mechanism, the take-up shaft 51 itself is rotated to rotate the core 55A for functioning as a take-up core of the ribbon cassette 46, through the engaging projections 56 formed on the outer peripheral surface of the take-up bobbin 47 fixed to the upper end portion of the take-up shaft 51 and also through the engaging grooves 64 formed in the inner peripheral surface of the associated core 55 of the ribbon cassette, thereby taking up the ink ribbon R around the outer periphery of the core 55A.

The structure of the second ink ribbon take-up mechanism, which corresponds to the portion of the second take-up bobbin 49 engaged with the associated pinch roller 63 of the ribbon cassette 46, has also been the same as that of the ink ribbon take-up mechanism described above.

However, since the outside diameter of the support shaft 51A in the conventional ink ribbon take-up mechanism is as small as 1.6 mm or so, there has been an inconvenience such that when taking up the ink ribbon R, the support shaft 51A is inclined or bent by being pulled with the tension working on the ink ribbon R. If the support shaft 51A rotates in an inclined state, the core 55A (pinch roller 63) engaged with the take-up bobbin 47(second take-up bobbin 49) may be inclined, making it impossible to effect a stable traveling of the ink ribbon.

Further, between the support shaft 51A and the take-up shaft 51 there is a clearance for making both shafts rotatable and between the take-up shaft 51 and the core 55A (pinch roller 63) there also is a clearance for insertion and engagement with respect to each other, so that the core 55A has a large wobbling. Consequently, the traveling of the ink ribbon R sometimes becomes unstable. It turned out that for improving the print quality it is necessary to stabilize the traveling of the ink ribbon and the take-up load and that therefore it is necessary to suppress inclination and wobbling of the core 55A (pinch roller 63).

SUMMARY OF THE INVENTION

It is an object of the present invention to provide an ink ribbon take-up mechanism capable of preventing tilting or wobbling of a core and a pinch roller caused by the tension of an ink ribbon at the time of taking up the ink ribbon in a ribbon cassette while a carriage is driven (during printing) and thereby capable of rotating the core and pinch roller of the ribbon cassette in a more stable manner.

According to the present invention, by inserting a support shaft into an engaging portion provided on the ribbon cassette side, the ribbon cassette-side engaging portion can be rotated by a drive transfer member while supporting the ribbon cassette through the ribbon cassette-side engaging portion.

Moreover, by bringing the drive transfer member, which projects from a ribbon cassette loading surface, into engagement with the ribbon cassette-side engaging portion, a rotative driving force of a motor can be transmitted from engaging projections of the drive transfer member to the ribbon cassette-side engaging portion.

Moreover, by inserting the support shaft into a core in the ribbon cassette to support the core and by bringing an engaging transfer member into engagement with the core, the rotative driving force of the motor is transmitted to the core to rotate the core, whereby the ink ribbon can be allowed to travel.

Further, by inserting the support shaft into a core and a pinch roller both disposed in a ribbon cassette to support the core and the pinch roller and by bringing the drive transfer member into engagement with the core and pinch roller to transmit the rotative driving force of the motor to the core and the pinch roller, thereby causing the core and the pinch roller to rotate, whereby the ink ribbon can be allowed to travel.

Additionally, since the support shaft itself comes into engagement, in a fixed state, with the ribbon cassette-side engaging portion, it is possible to support the ribbon cassette-side engaging portion more firmly.

DETAILED DESCRIPTION OF THE PREFERRED EMBODIMENTS

Ink ribbon take-up mechanisms embodying the present invention will be described below with reference to FIGS. 1 to 3. As to the other constructional points than the ink ribbon take-up mechanisms, they are the same as in the prior art unless otherwise mentioned.

Figure 1:
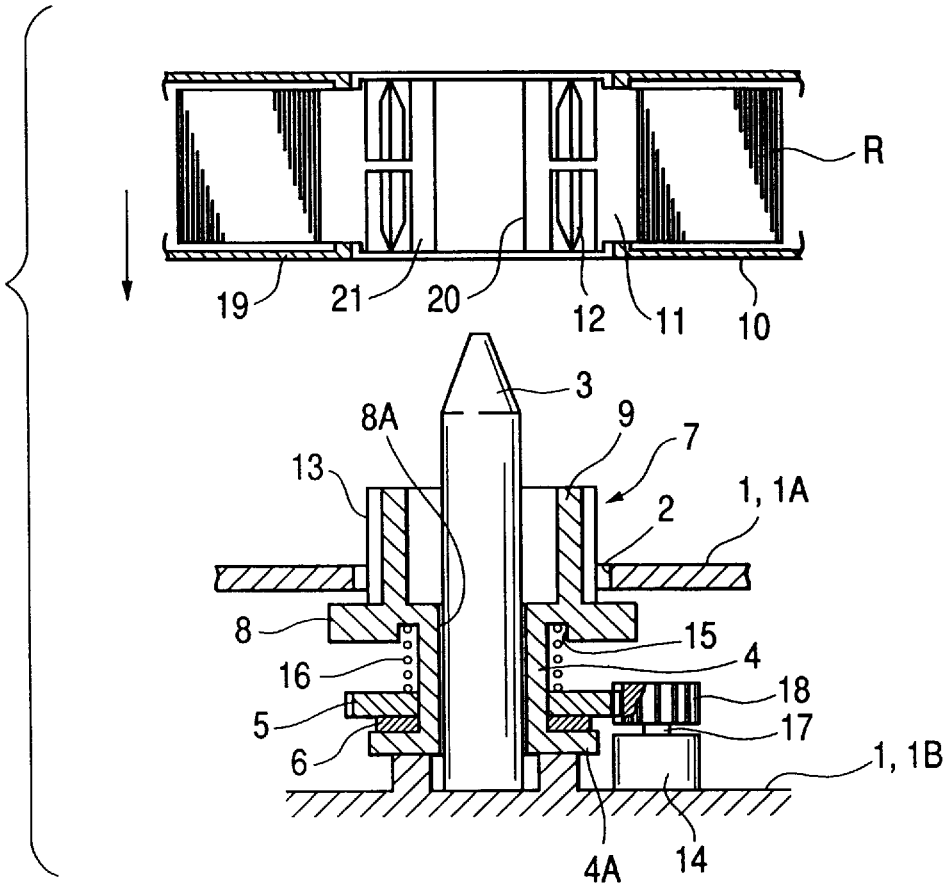
FIG. 1 is a sectional explanatory view showing an ink ribbon take-up mechanism according to the first embodiment of the present invention and also showing a ribbon cassette for engagement with the ink-ribbon take-up mechanism.

FIG. 1 illustrates an ink ribbon take-up mechanism according to the first embodiment of the present invention. The ink ribbon take-up mechanism of this embodiment has a core supporting shaft 3 whose upper portion is projected from a projection hole 2 formed in a ribbon cassette loading surface 1A of the carriage 1. The core supporting shaft 3 is fixed at its base portion to a base plate 1B of the carriage 1 and is formed such that an outside diameter is about 4 mm, which is as large as twice or more that of the support shaft 51A in the prior art which is about 1.6 mm in outside diameter. A rotatable member 4 having an outwardly projecting support flange 4A formed at the lower portion thereof is rotatably mounted on the core supporting shaft 3, and a take-up gear 5 is loosely fitted on the core supporting shaft 3 so as to be rotatable independently of the shaft 3. Between the take-up gear 5 and the support flange 4A is interposed a felt member 6 which constitutes a frictional slide mechanism, and a drive transfer member 7 for rotatively driving a core 11 in the ribbon cassette 10 is connected to an upper end portion of the rotatable member 4, whereby the rotation of the take-up gear 5 is transmitted to the drive transfer member 7 through the frictional slide mechanism and the rotatable member 4.

Figure 2:
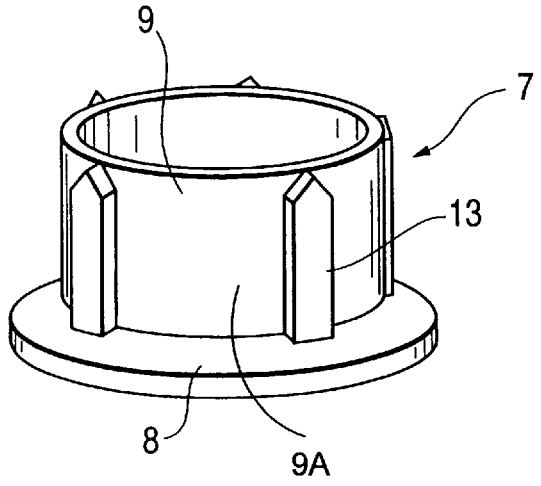
FIG. 2 is a perspective view showing a drive transfer member used in the ink ribbon take-up mechanism shown in FIG. 1.

In the drive transfer member 7, as shown in FIGS. 1 and 2, on the upper surface of the circular base plate 8 in which a hole 8A for inserting the core supporting shaft 3 is formed at the center, a generally cylindrical drive transfer portion 9 which is concentric with the hole 8A is formed.

The drive transfer portion 9 has engaging projections 13 formed on the outer peripheral surface thereof circumferentially at equal intervals, the engaging projections 13 being for engagement with engaging projections 12 formed convexly on the core 11 which serves as an engaging portion on the side of the ribbon cassette as will be described later The front end side of the drive transfer member 7 is disposed so that it is exposed to the ribbon cassette loading surface 1A of the carriage 1 from the projection hole 2 of the carriage 1 together with the core supporting shaft 3. The upper end side of the drive transfer member 7 projecting from the ribbon cassette loading surface 1A of the carriage 1 and the core supporting shaft 3 are allowed to function in the same manner as the take-up bobbin 47 in the conventional ribbon take-up mechanism.

Although in FIG. 1 the generally cylindrical drive transfer portion 9 used in this embodiment is projected a little smaller than half thereof in the thickness direction of the ribbon cassette 10 from the ribbon cassette loading surface 1A, no limitation is placed on such projection length insofar as the drive transfer portion 9 can engage the core 11 in the carriage-loadable ribbon cassette 10 and can transfer the driving force of the take-up motor 14 accurately.

In the underside of the circular base plate 8, at a position inside the drive transfer portion 9, is formed an annular retaining groove 15, and a biasing spring 16 as a resilient member which constitutes a frictional slide mechanism is mounted on the outer periphery side of the core supporting shaft 3. An upper end portion of the biasing spring 16 is anchored in the retaining groove 15 of the circular base plate 8 and a lower end portion thereof is in abutment with the upper surface of the take-up gear 5.

With the biasing force of the biasing spring 16, the underside of the take-up gear 5 is brought into pressure contact with the upper surface of the support flange 4A through the felt member 6. In the abutment portion between the biasing spring 16 and each associated member (for example in the retaining groove 15 in this embodiment) there may be disposed a slide plate if necessary. The retaining groove 15 may be formed in the upper surface of the take-up gear 5 or may be formed in both the lower surface of the circular base plate 8 and the upper surface of the take-up gear 5. Further, with the retaining groove 15 formed in neither the lower surface of the circular base plate 8 nor the upper surface of the take-up gear 5, the biasing spring 16 may be mounted so as to merely abut both the lower surface of the base plate 8 and the upper surface of the take-up gear 5.

A drive gear 18 fixed onto a rotating shaft 17 of the take-up motor 14 for the ink ribbon R is in mesh with the take-up gear 5. With rotation of the take-up motor 14, the drive gear 18 is rotated to rotate the take-up gear 5, resulting in that, due to a frictional force of the felt member 6 created by the biasing force of the biasing spring 16, the rotative driving force is transmitted to the drive transfer member 7 from the support flange 4A through the core supporting shaft 3. Thus, the take-up gear 5 does not rotate together with the core supporting shaft 3, but only the rotative driving force is transmitted to the drive transfer member 7 through the above frictional slide mechanism. The sliding motion of the frictional slide mechanism comprising the felt member 6 and the biasing spring 16 permits the ink ribbon to be taken up at a certain take-up pitch irrespective of the amount of the ink ribbon already taken up. A plurality of gears maybe interposed between the drive gear 18 and the take-up gear 5.

A pair of generally cylindrical cores 11, 11 are disposed within a case body 19 of the ribbon cassette 10 which is loaded onto the upper surface of the carriage 1, and both ends of the ink ribbon R, which is a heat-subliming or heat-melting ink ribbon, are wound round the outer peripheral surfaces of the cores 11, respectively.

The ribbon cassette 10 containing the ink ribbon R and shown in FIG. 1 according to this embodiment is of the type which is turned upside down and is loaded in this state onto the ribbon cassette loading surface 1A of the carriage 1 to permit printing. Each core 11 is formed with a shaft hole 20 for insertion therein of the core supporting shaft 3 disposed on the carriage 1. In the surface and the back surface of each core 11 which come to be approximately flush with the surface and the back surface, respectively, of the ribbon cassette 10 there are respectively formed annular core-side drive transfer portions 21 concentric with the shaft hole 20. The groove depth of each core-side drive transfer portion 21 is set at a value which permits complete reception therein of the drive transfer portion 9 of the drive transfer member 7 projecting from the ribbon cassette loading surface 1A of the carriage 1. The core-side drive transfer portion 21 formed with a groove is provided with a plurality of engaging projections 12 engaged with the engaging projections 13 formed at the inner peripheral wall 9A of an outer-side of the drive transfer portion 9 at the carriage 1 while being spaced apart in a circumferential direction in a spline manner.

As to an ink ribbon feed mechanism which comes into engagement with the core 11 on the ink ribbon feed side of the ribbon cassette 10, explanation thereof is here omitted, but at least the portion thereof projecting from the upper surface of the carriage 1 have a shaft for supporting the ink ribbon feed core like the core supporting shaft 3 in the above ink ribbon take-up mechanism and follow the draw-out operation for the ink ribbon R and traveling of the carriage 1 in accordance with the operation of the ink ribbon take-up mechanism.

The operation of this embodiment will be described below.

For loading the ribbon cassette 10 having the cores 11 constructed as above onto the ribbon cassette loading surface 1A of the carriage 1, the ribbon cassette 10 is depressed in the direction indicated with an arrow in FIG. 1, then in the ink ribbon take-up mechanism, the core supporting shaft 3 on the carriage 1 side is inserted into the shaft hole 20 formed in the take-up core 11 of the ribbon cassette 10, and the drive transfer portion 9 having the carriage 1-side engaging projections 13 is brought into engagement with the core-side drive transfer portion 21 (including the engaging projections formed on the inner peripheral wall of its outer side) of the core 11.

In this embodiment, the ribbon cassette 10 is employable in an inverted state, and when loaded onto the carriage 1, one of the paired cores 11, 11 comes into engagement with the core supporting shaft 3 and the drive transfer portion 9 as constituents of the ink ribbon take-up mechanism and functions as a take-up core for taking up the portion, which has been used for printing, of the ink ribbon R. The other core comes into engagement with the portion projecting from the ribbon cassette loading surface 1A of the carriage 1 in the ink ribbon feed mechanism, and functions as a feed core for feeding the ink ribbon R for printing.

In this state, the carriage 1 is moved, and in the ribbon take-up mechanism used in this embodiment, the drive gear 18 is rotated through the rotating shaft 17 by rotation of the take-up motor 14, thereby causing rotation of the take-up gear 5 which is in mesh with the drive gear 18. With a frictional force of the felt member 6 created by the biasing force of the biasing spring 16, the rotative driving force of the take-up gear 5 is transmitted through the support flange 4A to the drive transfer member 7 press-fitted in the hole 8A of the circular base plate 8.

The rotative driving force thus transmitted to the drive transfer member 7 is further transmitted to the core-side drive transfer portion 21 of the ribbon cassette 10 through the engaging projection 13 of the drive transfer portion 9. More specifically, while the ink ribbon R is taken up, the engaging projections 13 engaged with the engaging projections 12 of the core-side drive transfer portion 21 transmit the rotative driving force to the core-side drive transfer portion 21 while their side faces in the take-up direction of the engaging projections 13 are kept in abutment with side faces in the take-up direction of the engaging projections 12, to rotate the core and thereby take up the ink ribbon R.

The operation of the frictional slide mechanism composed of the biasing spring 16 and the felt member 6 will now be described briefly. When a certain tension or a higher tension is exerted on the ink ribbon R which is traveling, the take-up gear 5 rotates, but due to sliding caused by the frictional slide mechanism, the drive transfer member 7 does not rotate, whereby take-up of the ink ribbon R is not carried out. On the other hand, by the frictional slide mechanism, take-up of the ink ribbon R is carried out at a certain take-up pitch by only an amount corresponding to the amount of the ink ribbon drawn out with traveling of the carriage 1, irrespective of the amount of the ink ribbon already taken up.

In this embodiment, moreover, since the core supporting shaft 3 is formed at a larger diameter than that of the conventional drive shaft, it is possible to prevent the core supporting shaft from being inclined or bent under the tension of the ink ribbon R during its take-up motion. Besides, by fitting of the core supporting shaft 3 into the shaft hole 20 formed in the associated core 11 of the ribbon cassette 10, wobbling of the core 11 is eliminated, whereby the oscillation of the core induced by traveling of the carriage 1 and taking-up of the ink ribbon R is diminished to ensure a stable traveling of the ink ribbon.

Figure 3:
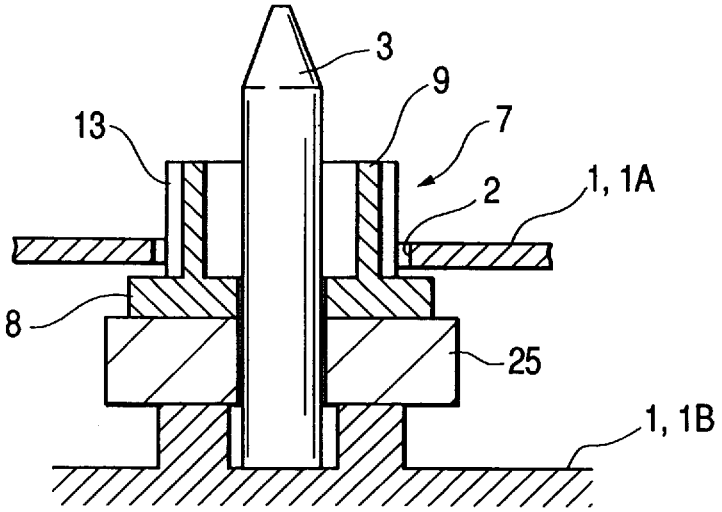
FIG. 3 is a sectional view of an ink ribbon take-up mechanism according to the second embodiment of the present invention.

FIG. 3 illustrates the second embodiment of the present invention. According to an ink ribbon take-up mechanism used in this second embodiment, in the ink ribbon take-up mechanism of the construction described in the previous first embodiment, the underside of the circular base plate 8 in the drive transfer member 7 is connected to a known friction clutch 25 so that a rotative driving force of a take-up motor (not shown) is transmitted to the drive transfer member 7 through the friction clutch 25.

Even in this construction, there is no fear of the core supporting shaft 3 being tilted or bent during the take-up operation for the ink ribbon R because the core supporting shaft 3 is formed to have a larger diameter than the diameter of the conventional drive shaft. Moreover, the core supporting shaft 3 is fitted into the shaft hole 20 formed in the associated core 11 of the ribbon cassette 10 to eliminate wobbling of the same core, whereby the oscillation of the core 11 induced by traveling of the carriage 1 and taking-up of the ink ribbon R is diminished to stabilize the traveling of the ink ribbon.

Figure 4:
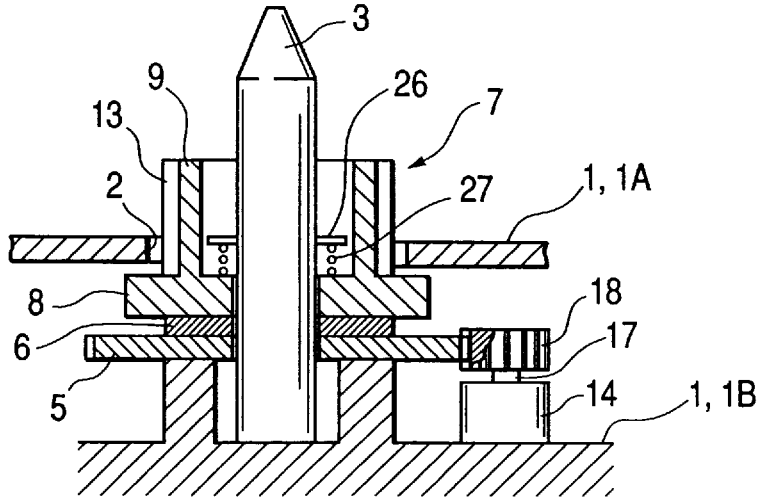
FIG. 4 is a sectional view of an ink ribbon take-up mechanism according to the third embodiment of the present invention.

FIG. 4 illustrates an ink ribbon take-up mechanism according to the third embodiment of the present invention. Only such constituent portions as are different from the previous two embodiments will now be described briefly. A base portion of the core supporting shaft 3 is fixed to the base plate 1B of the carriage 1, and onto the upper surface of the take-up gear 5 is mounted a drive transfer member 7 while being fitted on the core supporting shaft 3 rotatably through a felt member 6 which functions as a frictional slide mechanism. The core supporting shaft 3 is formed with a flange 26 which projects outward within the drive transfer portion 9. Further, on the outer periphery side of the core supporting shaft 3 is mounted a biasing spring 27 whose upper end portion is abutted against the lower surface of the flange 26 and whose lower end portion is abutted against the upper surface of the circular base plate 8 as a constituent of the drive transfer member.

Also in the ink ribbon take-up mechanism of such a construction, with the biasing force of the biasing spring 27, the circular base plate 8 of the driver transfer member 7 can be brought into pressure contact with the upper surface of the take-up gear 5 through the felt member 6.

With rotation of the take-up gear 5, the drive transfer member 7 rotates through the frictional slide mechanism, but since the core supporting shaft 3 firmly supports the associated core 11 of the ribbon cassette 10 as in the previous embodiments, it is possible to prevent oscillation of the core 11 which occurs with traveling of the carriage 1 and taking-up of the ink ribbon R and thereby ensure a stable traveling of the ink ribbon.

Figure 5:
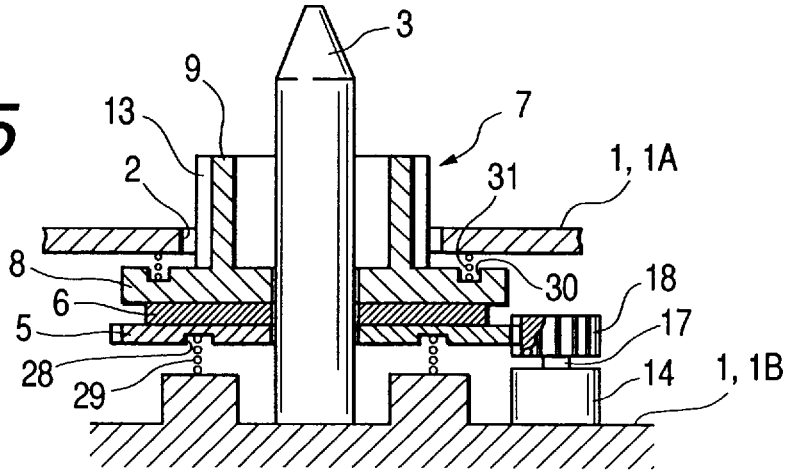
FIG. 5 is a sectional view of an ink ribbon take-up mechanism according to the fourth embodiment of the present invention.
Figure 6:
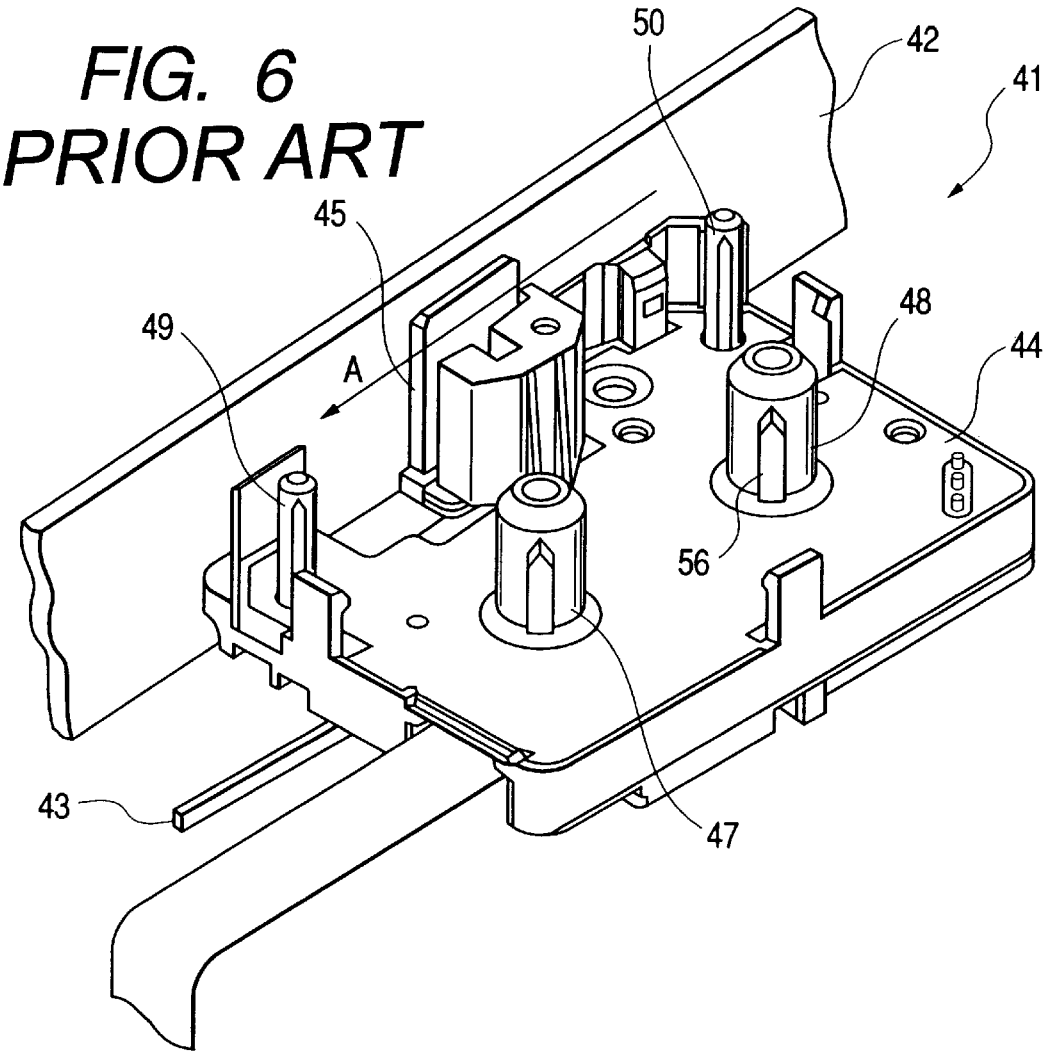
FIG. 6 PRIOR ART
FIG. 6 is a perspective view showing a principal portion of a general thermal transfer printer.
Figure 7:
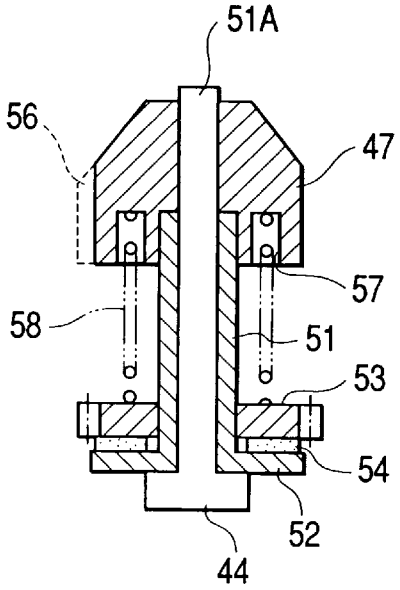
FIG. 7 PRIOR ART
FIG. 7 is a sectional view showing a principal portion of a conventional ink ribbon take-up mechanism.
Figure 8:
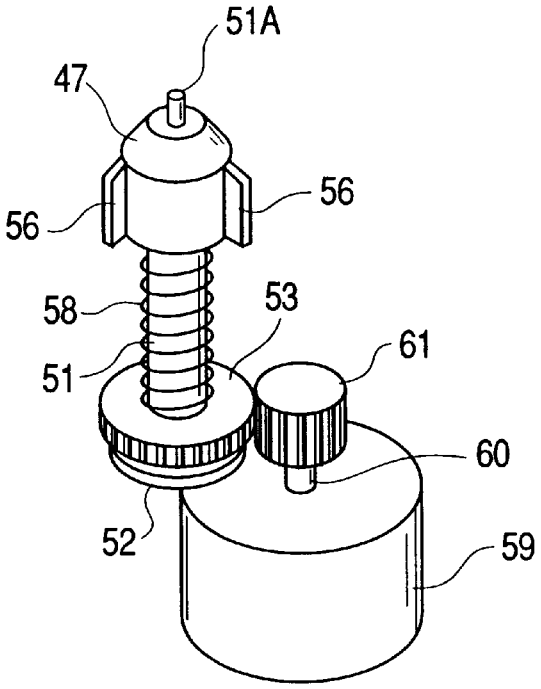
FIG. 8 PRIOR ART
FIG. 8 is a perspective view thereof.
Figure 9:
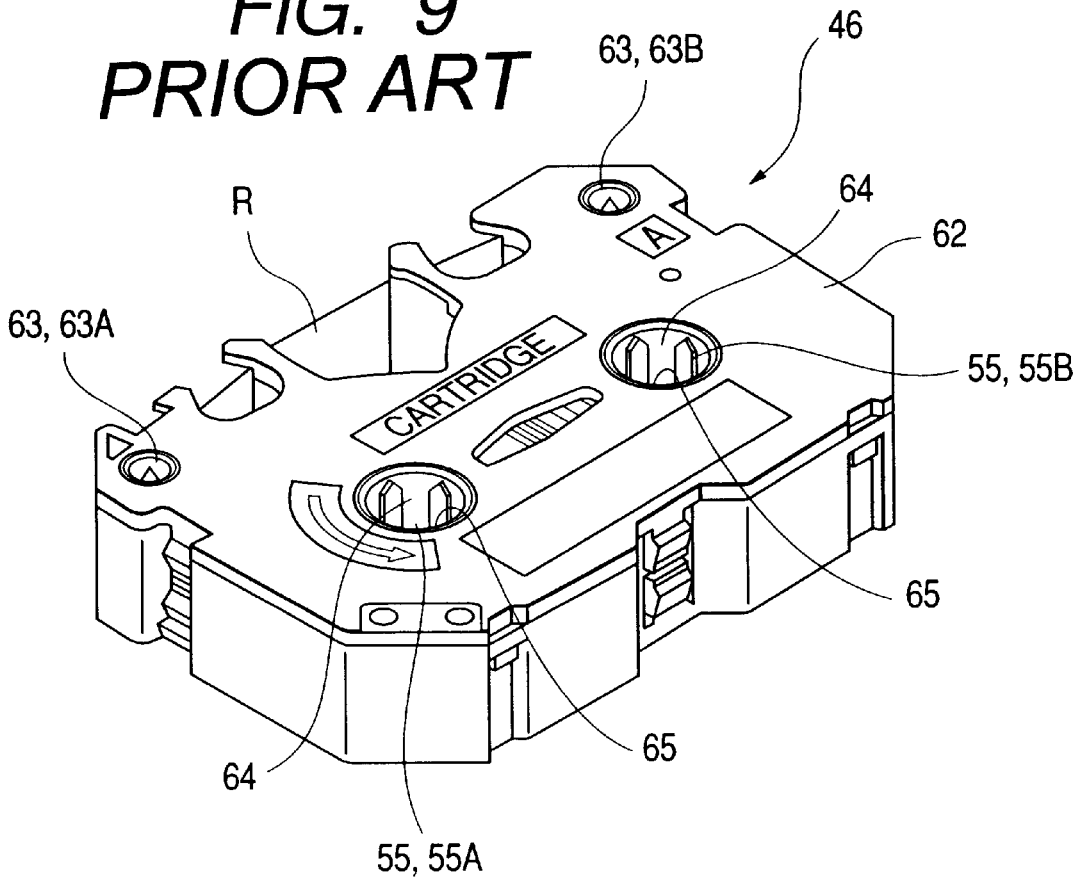
FIG. 9 PRIOR ART
FIG. 9 is a perspective view showing a general ribbon cassette structure.

FIG. 5 illustrates an ink ribbon take-up mechanism according to the fourth embodiment of the present invention. A brief description will now be given only about such constituent portions as are different from the previous three embodiments. A core supporting shaft 3 used in the ink ribbon take-up mechanism of this embodiment is disposed so that its base portion is fixed to the base plate 1B of the carriage 1 and its upper end portion is projected from a projection hole 2 formed in an upper plate of the carriage having a ribbon cassette loading surface 1A. A take-up gear 5 is fitted on the core supporting shaft 3 rotatably, and above the take-up gear 5 a drive transfer member 7 is fitted on the core supporting shaft 3 rotatably through a felt member 6 which functions as a frictional slide mechanism. An annular retaining groove 28 is formed in the underside of the take-up gear 5. On the outer periphery side of the base portion of the core supporting shaft 3 is disposed a biasing spring 29 whose upper end portion is anchored in the retaining groove 28 and whose lower end portion is brought into abutment with the fixed surface of the core supporting shaft 3 of the carriage 1. Also in the upper surface of the circular base plate 8 and on an outer periphery side with respect to the drive transfer portion 9 is formed an annular retaining groove 30. Further, a biasing spring 31 is mounted, with the core supporting shaft 3 fitted therein, in such a manner that its upper end portion is abutted against the back side of the upper plate of the carriage 1 and its lower end portion is anchored in the retaining groove 30 formed in the circular base plate 8.

In this embodiment, the frictional slide mechanism gives rise to slippage in its portion which comes into contact with the felt member 6 under the biasing force of the biasing spring 29 acting in a direction to depress the circular base plate 8 of the drive transfer member 7 and the biasing force of the biasing spring 31 acting in a direction to push up the take-up gear 5.

In the ink ribbon take-up mechanism of such a construction, since the core supporting shaft 3 is formed to have a large diameter and its base portion is fixed to the carriage 1, the ribbon cassette 10 can be supported more strongly upon fitting of the shaft 3 into the shaft hole 20 formed in the ribbon cassette 10. Consequently, the oscillation of the ribbon cassette 10 itself caused by traveling of the carriage 1 and taking-up of the ink ribbon R is prevented and a stable feed of the ink ribbon R can be effected.

The ink ribbon take-up mechanism according to the present invention is applicable not only to an ink ribbon take-up mechanism of the type which engages the take-up core of the ribbon cassette 10 but also to an ink ribbon take-up mechanism of the type disposed in the ribbon cassette 10 and engaging a pinch roller 63 which can be one of engaging portions on the ribbon cassette side. For example, even when applied to an ink ribbon take-up mechanism which engages the pinch roller, the outside diameter of a pinch roller supporting shaft can be set as large as 4 mm or so in comparison with that in the prior art which is 1.6 mm or less.

The present invention is not limited to the above embodiments, but various modifications may be made as necessary. For example, the take-up gear 5 may be rotated directly by the take-up motor 14, and also as to the ribbon cassette 10 fed to the take-up mechanism, it is not limited to the foregoing ribbon cassette 10 employable in an inverted state. The shape and the number of the engaging projections 13 are not limited, either, to those described in the above embodiments. Further, in all of the above embodiments, the support shaft 3 is fixed to the carriage 1 and does not rotate, there may be adopted a modification wherein the support shaft 3 itself also rotates while supporting an engaging portion on the ribbon cassette side.

In the ink ribbon take-up mechanism according to the present invention, as set forth hereinabove, the support shaft which constitutes the take-up mechanism can be made larger in diameter than in the prior art, and by fitting the support shaft into a shaft hole formed in a core or a pinch roller each of which serves as an engaging portion formed on the ribbon cassette side, the core or the pinch roller is supported firmly, whereby the support shaft is prevented from being tilted or bent during the ink ribbon taking-up operation. Further, by making the clearance small between the support shaft and the core or the pinch roller, the oscillation of the core or the pinch roller caused by traveling of the carriage or taking-up of the ink ribbon is prevented, thereby ensuring a stable traveling of the ink ribbon and affording good results of printing.

What is claimed is:

1. An ink ribbon take-up mechanism which comes into engagement with an engaging portion formed on the side of a ribbon cassette loaded onto a carriage of a printer and which uses a rotative driving force of a motor to take up an ink ribbon wound round a pair of cores of said ribbon cassette, said ink ribbon take-up mechanism comprising:

a support shaft projected from a ribbon cassette loading surface of said carriage to a ribbon cassette loading side and adapted to be inserted into said engaging portion formed on the ribbon cassette side to support the ribbon cassette; and a drive transfer member disposed rotatably on an outer periphery side of said support shaft and adapted to be engaged with said engaging portion formed on the ribbon cassette side to transmit the rotative driving force of said motor to said engaging portion, said drive transfer member having a circular base plate formed with a hole for insertion therein of said support shaft, and a generally cylindrical drive transfer portion formed on an upper surface of said circular base plate, said drive transfer portion having a plurality of engaging portions formed on an outer peripheral surface thereof circumferentially at equal intervals to transmit the rotative driving force to said engaging portion formed on the ribbon cassette side, and said drive transfer member is rotatably fitted on said support shaft so that a tip end side of said drive transfer portion is projected from a projection hole formed in said ribbon cassette loading surface.

2. An ink ribbon take-up mechanism according to claim 1, wherein said support shaft is fixed to said carriage.

* * * * *